US010223976B2

(12) United States Patent
Wang et al.

(10) Patent No.: US 10,223,976 B2
(45) Date of Patent: Mar. 5, 2019

(54) CIRCUIT AND METHOD FOR DRIVING AMOLED PIXEL TO REDUCE RESIDUAL IMAGES

(71) Applicant: Shenzhen China Star Optoelectronics Technology Co., Ltd., Shenzhen, Guangdong (CN)

(72) Inventors: Limin Wang, Guangdong (CN); Tai Jiun Hwang, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/500,214

(22) PCT Filed: Jan. 20, 2017

(86) PCT No.: PCT/CN2017/071789
§ 371 (c)(1),
(2) Date: Dec. 15, 2017

(87) PCT Pub. No.: WO2018/036098
PCT Pub. Date: Mar. 1, 2018

(65) Prior Publication Data

US 2018/0218689 A1 Aug. 2, 2018

(30) Foreign Application Priority Data

Aug. 25, 2016 (CN) ..... 2016 1 0719669

(51) Int. Cl.
*G09G 3/3225* (2016.01)
*G09G 3/3258* (2016.01)
(Continued)

(52) U.S. Cl.
CPC ..... *G09G 3/3291* (2013.01); *G09G 3/3225* (2013.01); *G09G 3/3258* (2013.01); *G09G 3/3266* (2013.01); *G09G 2330/027* (2013.01)

(58) Field of Classification Search
CPC .. G09G 3/3225; G09G 3/3258; G09G 3/3266; G09G 3/3291; G09G 2330/027
See application file for complete search history.

(56) References Cited

U.S. PATENT DOCUMENTS 6,947,019 B2 9/2005 Sato et al.
2010/0117932 A1* 5/2010 Yamashita ..... G09G 3/3233 345/55

(Continued)

FOREIGN PATENT DOCUMENTS

CN 102867491 A 1/2013
CN 103400546 A 11/2013

(Continued)

OTHER PUBLICATIONS

International Search Report dated Jun. 5, 2017 for International Patent Application No. PCT/CN2017/071789.

(Continued)

*Primary Examiner* — Ryan A Lubit

(57) ABSTRACT

Disclosed are a circuit and a method for driving an AMOLED pixel. The circuit includes a first transistor, a second transistor, and a grayscale storage capacitor. The circuit further comprises a third transistor. A source of the third transistor is connected to a drain of the first transistor; a drain thereof is connected to ground; and a gate thereof is configured to receive a shutdown control signal. The third transistor is turned on under control of the shutdown control signal and a predetermined shutdown sequence of voltages of respective portions of the circuit.

13 Claims, 2 Drawing Sheets

(51) Int. Cl.
*G09G 3/3266* (2016.01)
*G09G 3/3291* (2016.01)

(56) References Cited

U.S. PATENT DOCUMENTS

| | | | | |
|---|---|---|---|---|
| 2010/0177126 | A1* | 7/2010 | Inoue | G09G 3/007 345/690 |
| 2014/0071107 | A1* | 3/2014 | Hong | G09G 3/3291 345/211 |
| 2014/0092144 | A1 | 4/2014 | Kim et al. | |
| 2015/0009198 | A1* | 1/2015 | Park | G09G 3/3233 345/212 |
| 2016/0275859 | A1* | 9/2016 | Tseng | G09G 3/3233 |
| 2017/0076667 | A1* | 3/2017 | Numata | G09G 3/3258 |

FOREIGN PATENT DOCUMENTS

| | | | |
|---|---|---|---|
| CN | 103943064 | A | 7/2014 |
| CN | 104464618 | A | 3/2015 |
| CN | 104795040 | A | 7/2015 |
| CN | 105702206 | A | 6/2016 |
| CN | 105702207 | A | 6/2016 |
| CN | 106097974 | A | 11/2016 |
| WO | 2015180341 | A1 | 12/2015 |

OTHER PUBLICATIONS

Chinese Office Action dated Feb. 27, 2018 for Chinese Patent Application No. 2016107196695.

* cited by examiner

CIRCUIT AND METHOD FOR DRIVING AMOLED PIXEL TO REDUCE RESIDUAL IMAGES

CROSS-REFERENCE TO RELATED APPLICATIONS

This application claims the priority of Chinese patent application CN 201610719669.5, entitled "Circuit and method for driving AMOLED pixel" and filed on Aug. 25, 2016, the entirety of which is incorporated herein by reference.

FIELD OF THE INVENTION

The present disclosure relates to the technical field of organic display control, and in particular, to a circuit and a method for driving an AMOLED pixel.

BACKGROUND OF THE INVENTION

FIG. 1 schematically shows a drive circuit of a pixel of an AMOLED (active matrix organic light emitting diode) display device. The drive circuit has a 2T1C structure. As shown in FIG. 1, T1 is a switching transistor; T2 is a drive transistor; Cst is a grayscale storage capacitor; OLED is an organic light emitting diode; ELVDD is a drive signal; and ELVSS is a reference signal. When a scanning line G outputs a scanning signal and the switching transistor T1 is turned on, a grayscale data signal Vdata charges the grayscale storage capacitor Cst via the switching transistor T1. When the grayscale storage capacitor Cst is charged to a predetermined value, the drive transistor T2 is turned on, and the drive signal ELVDD enables the organic light emitting diode OLED to emit light through the drive transistor T2.

After the AMOLED display device is shut down, a natural discharge process of a data voltage Vdada output by a source drive chip is very slow, which affects a discharge speed at node A. Moreover, when the AMOLED display device is shut down, a continuous and effective turn-on voltage of a scanning drive chip cannot be ensured. As a result, the switching transistor T1 is turned off before the data voltage Vdada at the node A completely discharges, which blocks a discharge path of a voltage at the node A and further affects a discharge process at the node A. Consequently, a shutdown residual image occurs.

SUMMARY OF THE INVENTION

In order to solve the above problem, the present disclosure provides a circuit and a method for driving an AMOLED pixel for reducing or even eliminating the problem of residual image of an AMOLED display device.

According to one aspect of the present disclosure, a circuit for driving an AMOLED pixel is provided. The circuit comprises a first transistor, a second transistor and a grayscale storage capacitor. A source of the first transistor is connected to a data line, and a gate thereof is connected to a scanning line. A gate of the second transistor is connected to a drain of the first transistor, a source thereof is connected to a drive signal line, and a drain thereof is connected to an OLED. A first end of the grayscale storage capacitor is connected to the drain of the first transistor, and a second end thereof is connected to the drain of the second transistor. The grayscale storage capacitor is configured to store a grayscale voltage. The circuit further comprises a third transistor. A source of the third transistor is connected to the drain of the first transistor, a drain thereof is connected to ground, and a gate thereof is configured to receive a shutdown control signal. The third transistor is turned on under control of the shutdown control signal and a predetermined shutdown sequence of voltages of respective portions of the circuit.

According to one embodiment of the present disclosure, the circuit further comprises a voltage comparator. An output end of the voltage comparator is connected to the gate of the third transistor, and the voltage comparator generates the shutdown control signal according to a gamma voltage and a data drive voltage.

According to one embodiment of the present disclosure, the voltage comparator generating the shutdown control signal according to a gamma voltage and a data drive voltage further comprises: determining an AMOLED display device not entering a shutdown state and outputting a low level signal when the gamma voltage is higher than the data drive voltage; and determining the AMOLED display device entering the shutdown state and outputting a high level signal to serve as the shutdown control signal when the gamma voltage is lower than or equal to the data drive voltage.

According to one embodiment of the present disclosure, a positive power end of the voltage comparator receives a scanning signal high voltage, and a negative power end thereof is connected to ground.

According to one embodiment of the present disclosure, the gamma voltage has a value of any gamma voltage which is higher than the data drive voltage in a group of gamma voltages.

According to one embodiment of the present disclosure, the gamma voltage has a maximum gamma voltage value in the group of gamma voltages.

According to one embodiment of the present disclosure, the circuit further comprises a shutdown time sequence controller, which is configured to control turn-off of voltages of respective portions of the circuit according to a predetermined sequence.

According to one embodiment of the present disclosure, the shutdown time sequence controller turns off voltages of respective portions according to a following sequence: a gamma voltage, a chip operation voltage, a scanning signal high voltage, a scanning signal low voltage and a data drive voltage.

According to one embodiment of the present disclosure, the voltage comparator is arranged in an external drive system of a display panel of an AMOLED display device.

According to another aspect of the present disclosure, a method for driving the abovementioned circuit is further provided. The method comprises determining whether or not an AMOLED display device is in a shutdown state. If the AMOLED display device is in the shutdown state, a shutdown control signal is output so as to turn on a third transistor, and if the AMOLED display device is not in the shutdown state, the third transistor is not turned on.

According to the present disclosure, the problem of shutdown residual image of the AMOLED display device can be reduced or even eliminated by arranging a discharge path at a connection of a switching transistor and a drive transistor in a reasonable manner. Moreover, according to the present disclosure, redesign of a drive chip can be avoided, and the aforesaid technical effect can be achieved in an existing external drive system.

Other advantages, objectives, and features of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure or the prior art, and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in detail with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
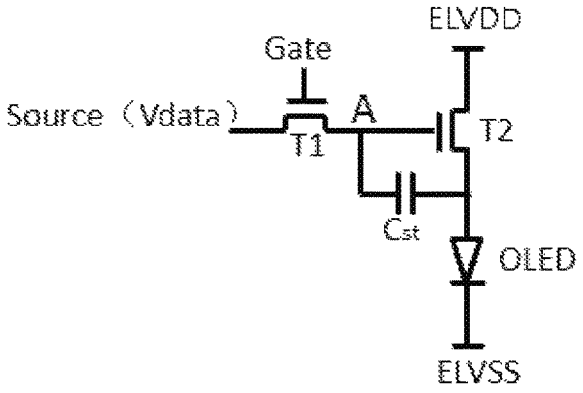
Fig. 1 (Prior Art)
FIG. 1 schematically shows a drive circuit of a pixel of an AMOLED display device in the prior art.
Figure 2:
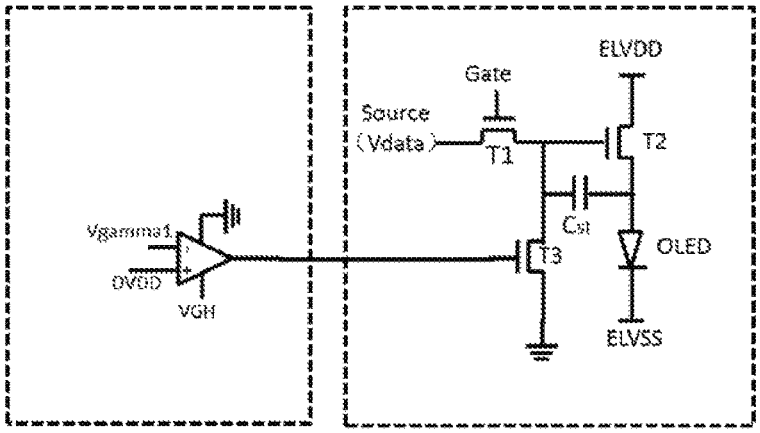
FIG. 2 schematically shows a drive circuit of a pixel of an AMOLED display device according to an embodiment of the present disclosure.

In order to solve the problem of shutdown residual image of an AMOLED display device, the present disclosure provides a circuit for driving an AMOLED pixel. FIG. 2 schematically shows a drive circuit of a pixel of the AMOLED display device according to an embodiment of the present disclosure. The present disclosure is explained in detail with reference to FIG. 2 hereinafter.

Figure 3:
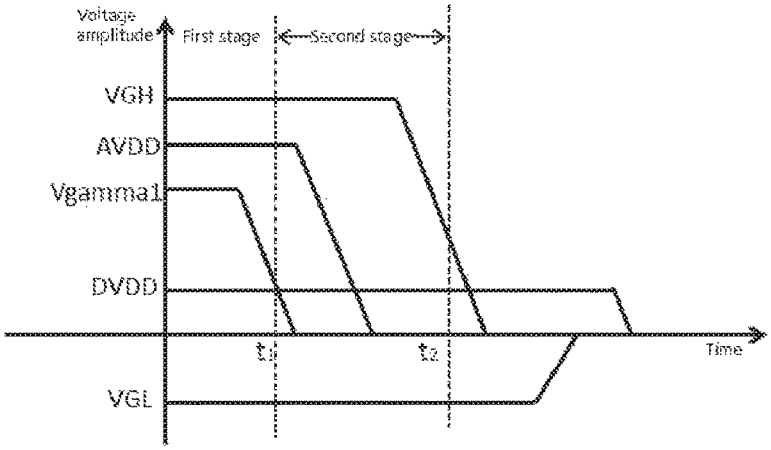
FIG. 3 schematically shows a voltage shutdown sequence in an AMOLED display device according to an embodiment of the present disclosure.

Generally, in an AMOLED drive system, in order to protect drive chips such as a source drive chip and a gate drive chip, a turn-on sequence and a turn-off sequence of voltages of respective portions are strictly arranged. In order to solve the problem of shutdown residual image of a display device, a shutdown voltage time sequence controller, which is configured to control a power-off sequence of respective portions of the drive circuit when the display device is turned off, is arranged in the drive circuit of a pixel. Specifically, a power-off sequence of respective portions in the AMOLED display device is arranged as: Vgamma, AVDD, VGH, VGL, DVDD, and a voltage shutdown sequence of respective portions in the AMOLED display device is shown in FIG. 3. In FIG. 3, Vgamma refers to a gamma voltage which is a display device parameter; AVDD refers to a chip operation voltage; VGH refers to a scanning signal high voltage (a scanning line voltage when a scanning signal is output); VGL refers to a scanning signal low voltage (a scanning line voltage when no scanning signal is output); and DVDD refers to a data drive voltage. Moreover, in order to facilitate control of shutdown residual image of the display device, Vgamma can be set as a value of any gamma voltage which is higher than the DVDD in a group of gamma voltages. This is because a numerical value relationship between the gamma voltage and the DVVD is used as a standard for determining whether the display device is turned off. A gamma voltage value which is equal to or lower than the DVDD cannot be selected, otherwise the critical point for shutdown cannot be determined. Preferably, a maximum gamma voltage value in a group of gamma voltages can be selected as Vgamma. The maximum gamma voltage value is represented by Vgamma 1, and Vgamma 1 is taken as an example for explanation in the present disclosure.

The circuit for driving an AMOLED pixel in the present disclosure comprises a first transistor T1, a second transistor T2 and a grayscale storage capacitor Cst. A source of the first transistor T1 is connected to a data line, and a gate thereof is connected to a scanning line. A gate of the second transistor T2 is connected to a drain of the first transistor T1; a source thereof is connected to a drive signal line; and a drain thereof is connected to an OLED. A first end of the grayscale storage capacitor Cst is connected to the drain of the first transistor T1, and a second end thereof is connected to the drain of the second transistor T2. The grayscale storage capacitor Cst is configured to store a grayscale voltage. Besides, the circuit further comprises a third transistor T3. A source of the third transistor T3 is connected to the drain of the first transistor T1; a drain thereof is connected to ground; and a gate thereof is connected to an external control signal. Under control of the external control signal and the voltage shutdown sequence of respective portions, the third transistor T3 is turned on so as to solve the problem of shutdown residual image of the AMOLED display device.

As shown in FIG. 2, in the present disclosure, the third transistor T3 is arranged between a connection of the first transistor T1 and the second transistor T2 and ground. When the display device is shut down, the third transistor T3 is turned on under control of the external control signal so as to guide remaining charges in the connection of the first transistor T1 and the second transistor T2 (i.e., remaining charges stored in the grayscale storage capacitor Cst) to ground, thereby solving the problem of shutdown residual image of the AMOLED display device.

In an embodiment of the present disclosure, the circuit further comprises a voltage comparator. As shown in FIG. 2, an output end of the voltage comparator is connected to the gate of the third transistor T3, and the voltage comparator generates a shutdown control signal according to the gamma voltage and the data drive voltage.

In an embodiment of the present disclosure, the voltage comparator generating a shutdown control signal according to the gamma voltage and the data drive voltage further comprises: when the gamma voltage is higher than the data drive voltage, it is determined that the AMOLED display device does not enter a shutdown state, and a low level signal is output; and when the gamma voltage is lower than or equal to the data drive voltage, it is determined that the AMOLED display device enters the shutdown state, and a high level signal is output to serve as the shutdown control signal. In this way, turn-on and turn-off of the third transistor can be controlled according to the numerical value relationship between the gamma voltage and the data drive voltage.

In an embodiment of the present disclosure, a positive power end of the voltage comparator receives the scanning signal high voltage VGH, and a negative power end thereof is connected to ground. The positive power end is configured to receive a turn-on voltage of the voltage comparator. Since an initial value of the scanning signal high voltage VGH is higher than the turn-on voltage of the voltage comparator, the voltage comparator can operate normally. When the display device is shut down, the scanning signal high voltage VGH gradually reduces. When the scanning signal high voltage VGH is lower than the turn-on voltage of the voltage comparator, the voltage comparator stops operation. In this way, operation states of the voltage comparator can be controlled according to variation of a value of the scanning signal high voltage VGH.

In an embodiment of the present disclosure, the voltage comparator is arranged in an external drive system of a display panel of the AMOLED display device, as shown in FIG. 2. In this way, the voltage comparator does not occupy a pixel display area and does not reduce an aperture ratio of a panel.

According to another aspect of the present disclosure, a method for driving the abovementioned circuit is provided. The method includes determining whether or not the AMOLED display device is in a shutdown state. If the AMOLED display device is in the shutdown state, a shutdown control signal is output, and the third transistor T3 is turned on. If the AMOLED display device is not in the shutdown state, the third transistor T3 is not turned on.

Figure 4:
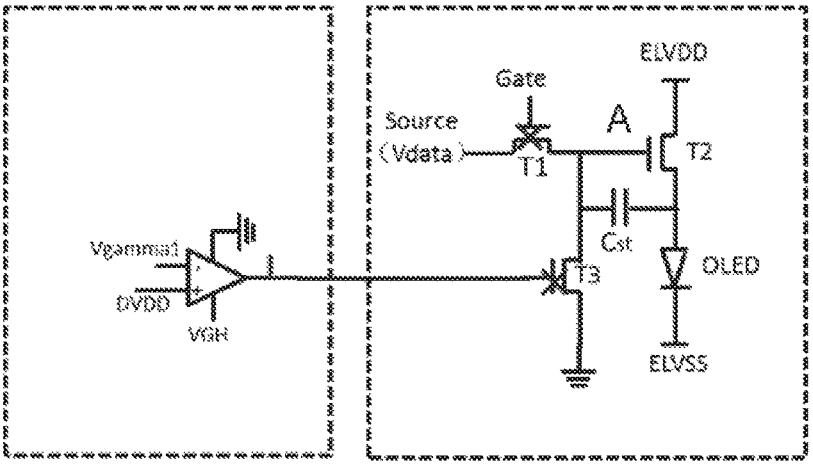
FIG. 4 schematically shows operation of the circuit as shown in FIG. 2 before a time point t1 as shown in FIG. 3.

Specifically, the driving process comprises two stages. A first stage refers to a time interval before a time point t1 as shown in FIG. 3, during which Vgamma1 is higher than DVVD. Here, the time point t1 is a critical point, and corresponds to a time point when Vgamma1 is equal to DVVD. During this time interval, the voltage comparator outputs a low level signal L; the third transistor T3 is in a turn-off state; and the first transistor T1 is turned off due to fluctuation of a scanning signal, as shown in FIG. 4. Since there is no discharge path, charges stored in the grayscale storage capacitor cannot be released, which causes residual charges at node A.

Figure 5:
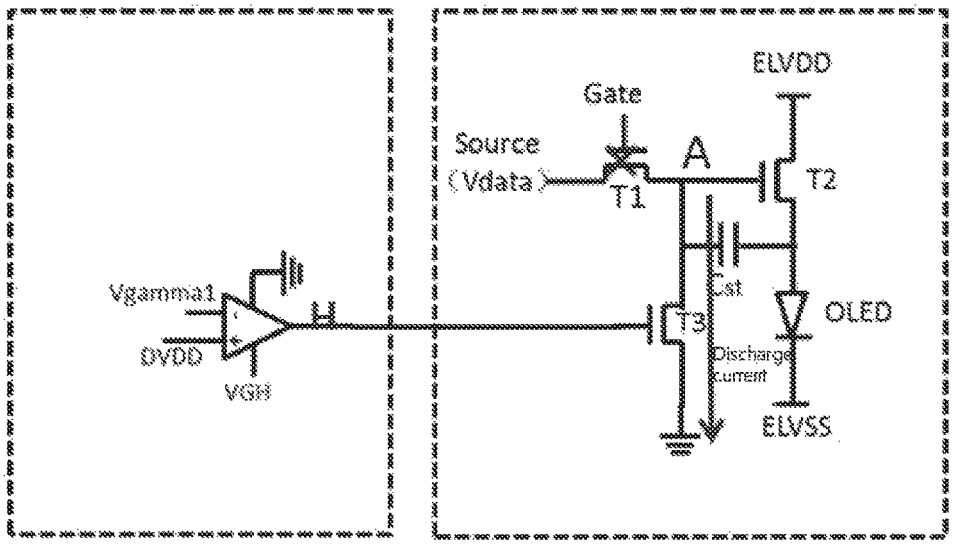
FIG. 5 schematically shows operation of the circuit as shown in FIG. 2 during a time interval from t1 to t2 as shown in FIG. 3.

The second stage refers to a time interval from t1 to t2 as shown in FIG. 3, during which Vgamma1 is lower than DVVD. The time point t2 refers to a time point when VGH is equal to a turn-on voltage of the third transistor T3. During this time interval, the voltage comparator outputs a high level signal H, and a process of eliminating shutdown residual image of the AMOLED display device begins. The third transistor T3 is turned on, and provides a discharge path for residual charges at the node A, as shown in FIG. 5. Since an operation voltage at the positive power end of the voltage comparator is provided by VGH, amplitude of an output high level signal is slightly lower than VGH, but the output high electric level is high enough for turning on the third transistor T3. Since amplitude of VGH starts to drop at a certain time point after the time point t1, an output electric level of the voltage comparator also drops. After the time point t2, an output electric level of the scanning line is lower than a turn-on voltage of the third transistor T3, and the process of eliminating shutdown residual image stops. By using a shutdown time sequence controller to adjust shutdown time of respective voltages so as to increase a time interval between the time point t1 and the time point t2, time of a stage for eliminating shutdown residual image can be prolonged, and a residual image elimination effect can be optimized.

According to the present disclosure, the problem of shutdown residual image of the AMOLED display device can be reduced or even eliminated by arranging the discharge path at a connection of the switching transistor and the drive transistor in a reasonable manner. Moreover, according to the present disclosure, redesign of a drive chip can be avoided, and the aforesaid technical effect can be achieved in an existing external drive system.

The above embodiments are described only for better understanding, rather than restricting the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A circuit for driving an AMOLED pixel, comprising:

a first transistor, wherein a source of the first transistor is connected to a data line, and a gate thereof is connected to a scanning line;

a second transistor, wherein a gate of the second transistor is connected to a drain of the first transistor, a source thereof is connected to a drive signal line, and a drain thereof is connected to an OLED;

a grayscale storage capacitor, wherein a first end of the grayscale storage capacitor is connected to the drain of the first transistor, and a second end thereof is connected to the drain of the second transistor, and wherein the grayscale storage capacitor is configured to store a grayscale voltage; and a third transistor, wherein a source of the third transistor is connected to the drain of the first transistor, a drain thereof is connected to ground, and a gate thereof is configured to receive a shutdown control signal, wherein the third transistor is turned on under control of the shutdown control signal and a predetermined shutdown sequence of voltages of respective portions of the circuit.

2. The circuit according to claim 1, further comprising a voltage comparator, wherein an output end of the voltage comparator is connected to the gate of the third transistor, and the voltage comparator generates the shutdown control signal according to a gamma voltage and a data drive voltage.

3. The circuit according to claim 2, wherein the voltage comparator generating the shutdown control signal according to a gamma voltage and a data drive voltage further comprises:

determining an AMOLED display device not entering a shutdown state and outputting a low level signal when the gamma voltage is higher than the data drive voltage; and determining the AMOLED display device entering the shutdown state and outputting a high level signal to serve as the shutdown control signal when the gamma voltage is lower than or equal to the data drive voltage.

4. The circuit according to claim 2, wherein a positive power end of the voltage comparator receives a scanning signal high voltage, and a negative power end thereof is connected to ground.

5. The circuit according to claim 3, wherein a positive power end of the voltage comparator receives a scanning signal high voltage, and a negative power end thereof is connected to ground.

6. The circuit according to claim 3, wherein the gamma voltage has a value of any gamma voltage which is higher than the data drive voltage in a group of gamma voltages.

7. The circuit according to claim 5, wherein the gamma voltage has a value of any gamma voltage which is higher than the data drive voltage in a group of gamma voltages.

8. The circuit according to claim 6, wherein the gamma voltage has a maximum gamma voltage value in the group of gamma voltages.

9. The circuit according to claim 7, wherein the gamma voltage has a maximum gamma voltage value in the group of gamma voltages.

10. The circuit according to claim 1, further comprising a shutdown time sequence controller, which is configured to control turn-off of voltages of respective portions of the circuit according to a predetermined sequence.

11. The circuit according to claim 10, wherein the shutdown time sequence controller turns off voltages of respective portions according to a following sequence: a gamma voltage, a chip operation voltage, a scanning signal high voltage, a scanning signal low voltage and a data drive voltage.

12. The circuit according to claim 2, wherein the voltage comparator is arranged in an external drive system of a display panel of an AMOLED display device.

13. A method for driving a circuit of an AMOLED pixel, wherein the circuit includes:

a first transistor, wherein a source of the first transistor is connected to a data line, and a gate thereof is connected to a scanning line;

a second transistor, wherein a gate of the second transistor is connected to a drain of the first transistor, a source thereof is connected to a drive signal line, and a drain thereof is connected to an OLED;

a grayscale storage capacitor, wherein a first end of the grayscale storage capacitor is connected to the drain of the first transistor, and a second end thereof is connected to the drain of the second transistor, and wherein the grayscale storage capacitor is configured to store a grayscale voltage; and a third transistor, wherein a source of the third transistor is connected to the drain of the first transistor, and a drain thereof is connected to ground, and a gate thereof is configured to receive a shutdown control signal, wherein the third transistor is turned on under control of the shutdown control signal and a predetermined shutdown sequence of voltages of respective portions of the circuit, and wherein the method comprises:

determining whether or not an AMOLED display device is in a shutdown state, wherein if the AMOLED display device is in the shutdown state, a shutdown control signal is output so as to turn on a third transistor, and wherein if the AMOLED display device is not in the shutdown state, the third transistor is not turned on.

* * * * *